United States Patent [19]

Labate

[11] Patent Number: 4,799,650

[45] Date of Patent: Jan. 24, 1989

[54] SLAG RETAINING DEVICE WITH VORTEX INHIBITOR

[76] Inventor: Michael D. Labate, 115 Hazen Ave., Ellwood City, Pa. 16117

[21] Appl. No.: 100,354

[22] Filed: Sep. 23, 1987

[51] Int. Cl.[4] ..... C21B 3/04

[52] U.S. Cl. ..... 266/227; 222/597

[58] Field of Search ..... 266/45, 272, 229, 227, 266/230; 222/597

[56] References Cited

U.S. PATENT DOCUMENTS

| | | | |
|---|---|---|---|
| 4,494,734 | 1/1985 | LaBate et al. | 266/272 |
| 4,601,415 | 7/1986 | Koffron | 266/227 |
| 4,610,436 | 9/1986 | LaBate, II et al. | 266/272 |
| 4,709,903 | 12/1987 | LaBate | 266/227 |

*Primary Examiner*—John P. Sheehan
*Assistant Examiner*—S. Kastler
*Attorney, Agent, or Firm*—Harpman & Harpman

[57] ABSTRACT

A device for the separation of slag insuring its retention in a tapping converter such as used in the steel industry consists of a closure having a specific gravity lower than that of the steel produced in the converter but higher than that of the slag provided with an elongated depending hexahedron shaped extension that tapers downwardly to a blunt end and acts as a vortex inhibitor within the swirl of molten metal occuring during the tapping of the metal to avoid formation of a suction funnel which typically draws the slag layer into a stream of metal being tapped.

6 Claims, 1 Drawing Sheet

SLAG RETAINING DEVICE WITH VORTEX INHIBITOR

BACKGROUND OF THE INVENTION

1. Technical Field

This invention relates to a slag retaining device and vortex inhibitor for use in tapping converters during the tapping of steel therefrom. The use of the device disclosed herein permits the tapping of steel free from slag.

2. Description of the Prior Art

Prior devices for blocking or minimizing slag carry over when tapping molten metal from a furnace or converter are known in the art and typical disclosures of such devices may be seen in U.S. Pat. Nos. 4,462,574 to Keenan, 4,494,734 to Micheal D. LaBate, et al., 4,601,415 to Koffron, and 4,610,436 to Micheal D. LaBate, et al.

A further disclosure of typical prior art may be seen in co-pending application Ser. No. now U.S. Pat. No. 4,709,903, 860,826, allowed July 9, 1987.

It is an object of the present invention to overcome the disadvantages of the above-mentioned prior art and to provide an improved floatable device for minimizing slag carry over during tapping of molten metal from a furnace or converter which device has the dual function of initially inhibiting the formation of a vortex in the stream of metal being tapped to reduce the tendency of slag to be drawn thereinto as well as subsequently forming a closure blocking the flow of molten metal prior to the slag layer on the molten metal reaching the point of tapping.

SUMMARY OF THE INVENTION

The slag retaining device of the present invention combines in one device a structure having the dual functions of inhibiting the vortex in a tapped metal stream that tends to draw slag thereinto and simultaneously acting as a means holding the slag away from a vortex or the area in which a vortex forms in the molten metal being tapped. This is accomplished by forming the slag retaining device in a shape that includes an enlarged circular portion defining a closure provided with a depending hexahedron shaped extension therebelow which tapers downwardly to a blunt end and is of a length at least equal to the axial dimension of the closure portion of the device.

DESCRIPTION OF THE PREFERRED EMBODIMENT

Figure 1:
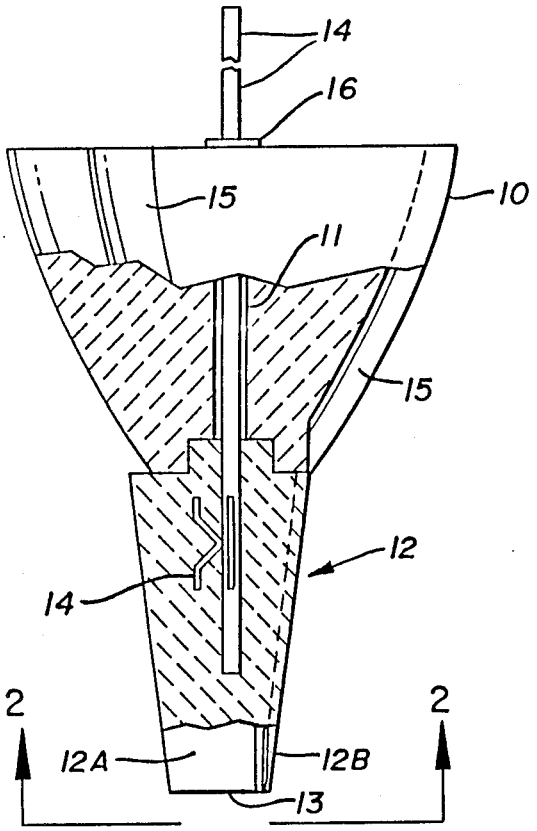
FIG. 1 is a side elevation of the slag retaining device with parts in cross section and parts broken away.

In the form of the invention disclosed herein the slag retaining device and vortex inhibitor comprises a circular closure member 10 having an axial passageway 11 therein and a depending elongated hexahedron shaped extension 12 which tapers from its widest dimension where it joins the circular closure member 10 to a transversely flat lower end 13. A metal rod 14 is positioned through the axial passageway 11 of the circular closure member 10 and extends downwardly into the elongated hexahedron shaped extension 12 and is secured therein by anchors 14'. Both the circular closure member 10 and the hexahedron shaped extension 12 are preferably formed of refractory materials having a density between 0.12 and 0.22 lbs. per cubic inch, the refractory materials being substantially indissoluble in the molten metal and slag. The circular closure member 10 has several circumferentially spaced rounded grooves 15 formed in its outer annular surface which terminate immediately above the elongated hexahedron shaped extension 12. The device of the invention is preferably formed in two parts as illustrated and retained in assembled relation on the rod 14 by a fitting 16 with the joining surfaces of the two sections provided with a suitable ceramic cement. Alternately the device may be formed in a single unitary structure with or without the rod 14 positioned therein.

Figure 2:
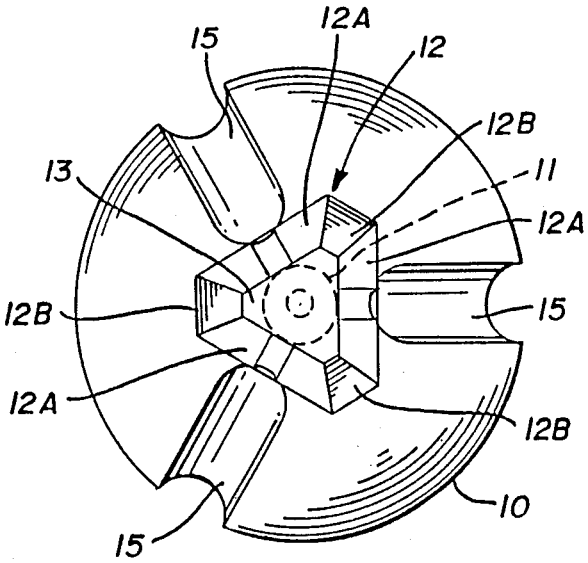
FIG. 2 is a bottom elevation on line 2—2 of FIG. 1.

By referring to FIG. 2 of the drawings in particular, it will be seen that the depending elongated hexahedron shaped extension 12 has six downwardly tapering surfaces, three of which, 12A, are substantially wider than the remaining alternately spaced narrower panels 12B. The general shape of the downward extension 12 is a modified triangular shape, the longitudinal corners of the triangular shape being flattened to form the narrow panels 12B.

Still referring to FIG. 2 of the drawings, it will be seen that the lowermost end 13 of the depending elongated hexahedron shaped extension 12 is transversely flat. It will also be observed that the modified triangular shape created by the hexahedron shape of the downward extension 12 provide six angular configurations, each of which is circumferentially placed with respect to the other and which insures adequate engagement in the swirling stream of molten metal adjacent the tapping point sufficient to inhibit the vortex which tends to form therein.

Figure 3:
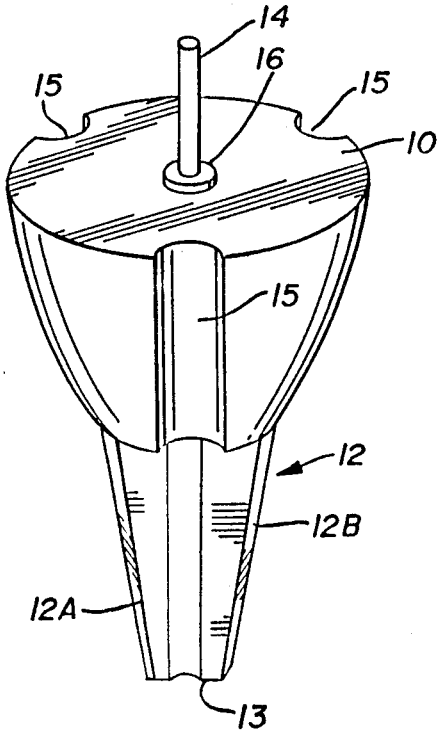
FIG. 3 is a perspective elevation of the slag retaining device with vortex inhibitor.

By referring now to FIG. 3 of the drawings, the spaced arrangement of the angular corners of the six hexahedron shaped planes 12A and 12B of the device will be seen to correspond in fixed relation to the upwardly and outwardly curving grooves 15 formed in circumferentially spaced relation in the closure member 10 of the device. Grooves 15 may extend down the planes 12A.

Figure 4:
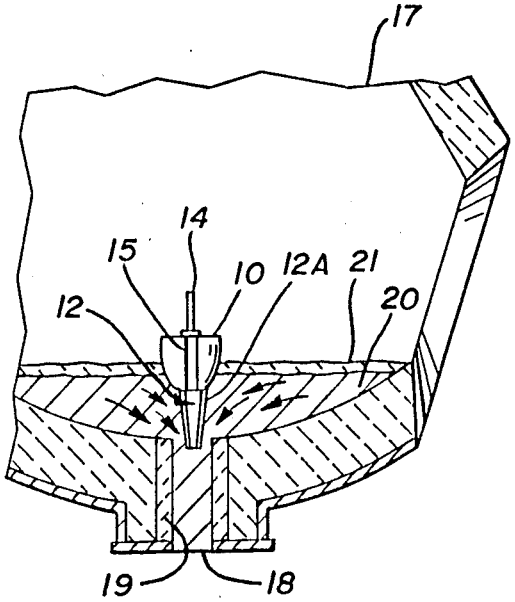
FIG. 4 is a cross sectional view of a portion of a converter showing the tap hole therein, molten steel above the tap hole and molten slag thereon and the slag retaining device positioned therein.

Be referring now to FIG. 4 of the drawings, a cross section of a portion of a tapping converter 17 may be seen with a tap hole 18 therein defined by a ceramic sleeve 19 and molten steel 20 therein carrying a slag layer 21. Arrows in the molten steel 20 define the flow path of the molten metal and it will be seen that the unique configuration of the device of the invention disclosed herein insures both the positioning of the device and its ability to inhibit the formation of a vortex in the flowing metal which would otherwise occur as well as form a closure.

It will thus be seen that the combination of the six panels 12A and 12B of the tapering hexahedron shaped extension 12 of the device and the rounded circular closure member 10 with the circumferentially spaced curving grooves 15 form a structure that floats in a highly desirable vertical position in the flowing molten steel above the top hole and insures against the formation of a vortex which tends to pull slag on the molten metal into the path of the molten steel being tapped and additionally acts to close the tap hole when the layer of molten steel remaining reaches a critical point so as to insure the retention of the slag in the converter and thereby insuring the delivery of clean steel from the tapping converter. The device of the invention may be formed of a mix comprising refractory cement 8 lbs., fine iron ore concentrate 16 lbs., steel shot 30 lbs., stainless steel fibers 2 lbs. and water from 3 to 5 lbs. This formula will produce a body having a density from 0.15 to 0.17 lbs/cubic inch although any density between that of the slag 0.10 lbs./cubic inch and that of molten steel, about 0.25 lbs./cubic inch is suitable. The tapered hexahedron shaped extension 12 may be formed of a similar mix having a greater density than that of the circular closure 10 so as to position the extension downwardly therefrom in the molten metal.

Although but one embodiment of the present invention has been illustrated and described, it will be apparent to those skilled in the art that various changes and modifications may be made therein without departing from the spirit of the invention and having thus described my invention what I claim is:

1. An improvement in a device for the retention of slag during drawing off of molten metal from a vessel provided with a tap hole, the device comprising a circular closure of a size to effectively close said tap hole and having means for inhibiting the suction generated by the vortex formed above the tap hole to prevent mixture of the slag with the molten metal being discharged through the tap hole, wherein said means comprises an elongated tapered member of hexahedron shape extending downwardly from said closure and having several generally planar faces arranged circumferentially thereof whereby said closure and tapered member generally conform with the shape of the vortex throughout its length, said device having a specific gravity less than the specific gravity of said molten metal and greater than the specific gravity of said slag.

2. The invention defined in claim 1 wherein said elongated tapered member comprises a hexahedron shaped body, a transversely flat lower end on said body.

3. The invention defined in claim 1 wherein said circular closure is of a known density and said elongated tapered member is of a greater density for positioning said tapered member downwardly with respect to said circular closure so as to be surrounded by said molten metal forming said vortex.

4. The invention defined in claim 1 wherein said closure and said tapered member are formed from castable refractory material containing iron ore concentrate, steel shot and fibers.

5. The invention as defined in claim 1 wherein a plurality of circumferentially spaced grooves are formed in said circular closure.

6. The invention defined in claim 1 wherein a groove is formed longitudinally in each of said planar faces of said elongated member.

* * * * *